US007137876B2

(12) United States Patent
Immordino, Jr. et al.

(10) Patent No.: US 7,137,876 B2
(45) Date of Patent: Nov. 21, 2006

(54) ADJUSTABLE HEAD ASSEMBLY FOR FLOOR BURNISHER

(75) Inventors: Joseph Immordino, Jr., Hoffman Estates, IL (US); Gary E. Palmer, Buchanan, TN (US)

(73) Assignee: Woodhead Industries, Inc., Deerfield, IL (US)

( * ) Notice: Subject to any disclaimer, the term of this patent is extended or adjusted under 35 U.S.C. 154(b) by 146 days.

(21) Appl. No.: 10/316,541

(22) Filed: Dec. 11, 2002

(65) Prior Publication Data

US 2003/0114091 A1 Jun. 19, 2003

Related U.S. Application Data

(60) Provisional application No. 60/340,321, filed on Dec. 14, 2001.

(51) Int. Cl.
*B24B 23/02* (2006.01)

(52) U.S. Cl. ..... 451/353; 451/15; 451/380

(58) Field of Classification Search ..... 451/359, 451/353, 350; 15/380, 340.2
See application file for complete search history.

(56) References Cited

U.S. PATENT DOCUMENTS

| | | | | | |
|---|---|---|---|---|---|
| 1,013,534 | A | * | 1/1912 | Cheney | 451/353 |
| 4,731,956 | A | * | 3/1988 | Wood | 451/353 |
| 4,805,258 | A | * | 2/1989 | Sitarski et al. | 15/385 |
| 6,227,957 | B1 | * | 5/2001 | Legatt et al. | 451/350 |
| 6,538,258 | B1 | * | 3/2003 | Rau et al. | 250/504 R |

FOREIGN PATENT DOCUMENTS

| | | | | |
|---|---|---|---|---|
| SU | 745652 | * | 7/1980 | 451/353 |

* cited by examiner

*Primary Examiner*—Robert A. Rose
(74) *Attorney, Agent, or Firm*—Emrich & Dithmar LLC

(57) ABSTRACT

The head assembly of a floor burnisher is suspended by a main lift assembly and a fine adjustment assembly. The main lift moves the head assembly between a raised position in which the pad assembly is raised and tilted for access, and a lowered position in which the pad driver is suspended slightly above the floor, ready for use. The fine adjustment assembly permits the operator to control very accurately and conveniently the final operating pressure of the pad when the burnisher is turned on.

7 Claims, 6 Drawing Sheets

ADJUSTABLE HEAD ASSEMBLY FOR FLOOR BURNISHER

RELATED APPLICATION

This application claims benefit under 35 U.S.C. 120 of U.S. application No. 60/340,321 entitled "Adjustable Head Assembly for Floor Scrubber", filed Dec. 14, 2001.

FIELD OF THE INVENTION

The present invention relates to high speed floor polishers or "burnishers" as they are commonly called. In particular, the present invention relates to a commercial battery burnisher in a walk-behind machine wherein the pad driver and head assembly are supported in front of the machine.

BACKGROUND OF THE INVENTION

High speed floor burnishers typically include a circular polishing element (pad or brush) mounted beneath a shroud or cover and forming a pad driver assembly. The pad driver is mounted beneath an electric motor energized by batteries or conventional wall outlet so that the motor may drive the pad directly. The combination of motor, shroud and pad are sometimes referred to as the head assembly.

In the case of larger machines, the motor is driven by a number of large storage batteries. In order to provide mobility, the batteries are carried on a chassis and enclosed within a housing; and the head assembly is mounted in front of the housing for movement between a raised position for maintenance, transport or storage, and a lowered position, in which the pad driver is located just above the floor with the bottom surface of the pad generally parallel to the floor. When the motor is turned on, rotation of the pad creates a suction effect, and the head assembly is drawn down to the floor to exert a downward pressure on the floor by the rotating pad, thus polishing the floor.

The head assembly, primarily because it includes a fairly large electric motor, may have considerable weight, and mounting the head assembly cantilevered in front of the machine has been found to present problems. For example, it is desirable that the operator be able to move the head assembly between the transport position and the use or ready (lowered) position manually so that costly additional actuators or power mechanisms need not be included.

Another problem sometimes present in burnishing machines of this type is that it is difficult to adjust the pressure which the pad is creating on the floor being burnished. Electrical systems have been developed for measuring the pad pressure on the floor, and a display of that pressure may be presented at a console in front of the operator. Typically, a needle indicates that the operating pressure is within design range which may be graphically indicated by a green band. Pressure measuring systems are commercially available. It has been a problem, however, to adjust the operating pressure so that it is within the desired operating range during operation of the machine.

SUMMARY OF THE INVENTION

The present invention provides a mount for the head assembly in front of a floor burnisher in which the head assembly is suspended by a main lift assembly which includes a counterbalance mechanism in the form of coil springs. The main lift assembly offsets most, but not all, of the weight of the head assembly.

A four-bar linkage mounts the head assembly to the frame (chassis) of the burnisher machine such that when the main lift assembly places the head assembly in the ready position, the pad is generally parallel to the floor and slightly above the floor surface. When the motor is turned on, suction created by the driven pad draws the pad driver and the pad into contact with the floor for burnishing operation, creating the downward pressure of the pad on the floor being polished.

The main counterbalance support assembly is also capable of manual operation, when the motor is turned off, permitting the operator to place his foot on a pedal and push downwardly to elevate the head assembly to the raised position for transport, storage or maintenance. In the raised position, the four-bar linkage mentioned above tilts the head assembly so that the pad extends upwardly and away from the floor in front of the machine, thereby rendering the pad and pad driver accessible for inspection, maintenance or repair.

A fine adjustment assembly is incorporated into the main lift assembly, and it permits the operator to control very accurately and conveniently the final operating pressure of the pad when the burnisher is in operation.

The fine adjustment assembly includes a rotatable adjusting knob located adjacent the operator's console. When the operator turns the adjusting knob in one direction, it increases the pressure of the pad, and when turned in a counter direction, it decreases the pressure of the pad. Since the main lift assembly counterbalances most of the weight of the head assembly, the fine adjust assembly permits the operator to adjust the final operating pressure over a very small range, and to do so very accurately, adjusting the operating pressure to the desired range while monitoring the actual operating pressure.

Other features and advantages of the present invention will be apparent to persons skilled in the art from the following detailed description of the illustrated embodiment, accompanied by the attached drawing where identical reference numerals will refer to like parts in the various views.

DETAILED DESCRIPTION OF THE ILLUSTRATED EMBODIMENT

Figure 1:
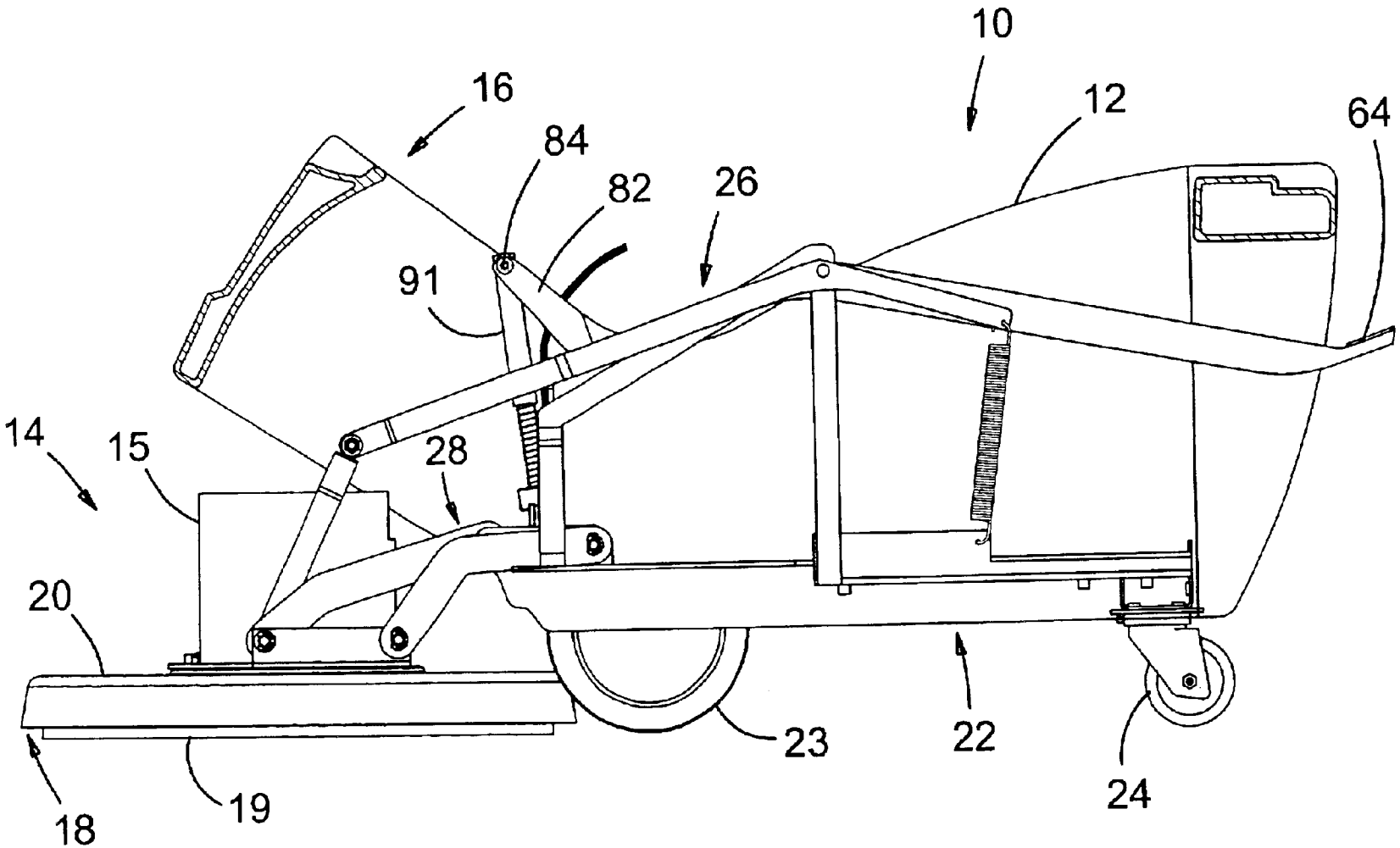
FIG. 1 is a side elevational view of a head assembly, the main lift assembly, and the fine adjustment assembly for a floor burnishing machine, with the housing of the machine shown in light line.
Figure 2:
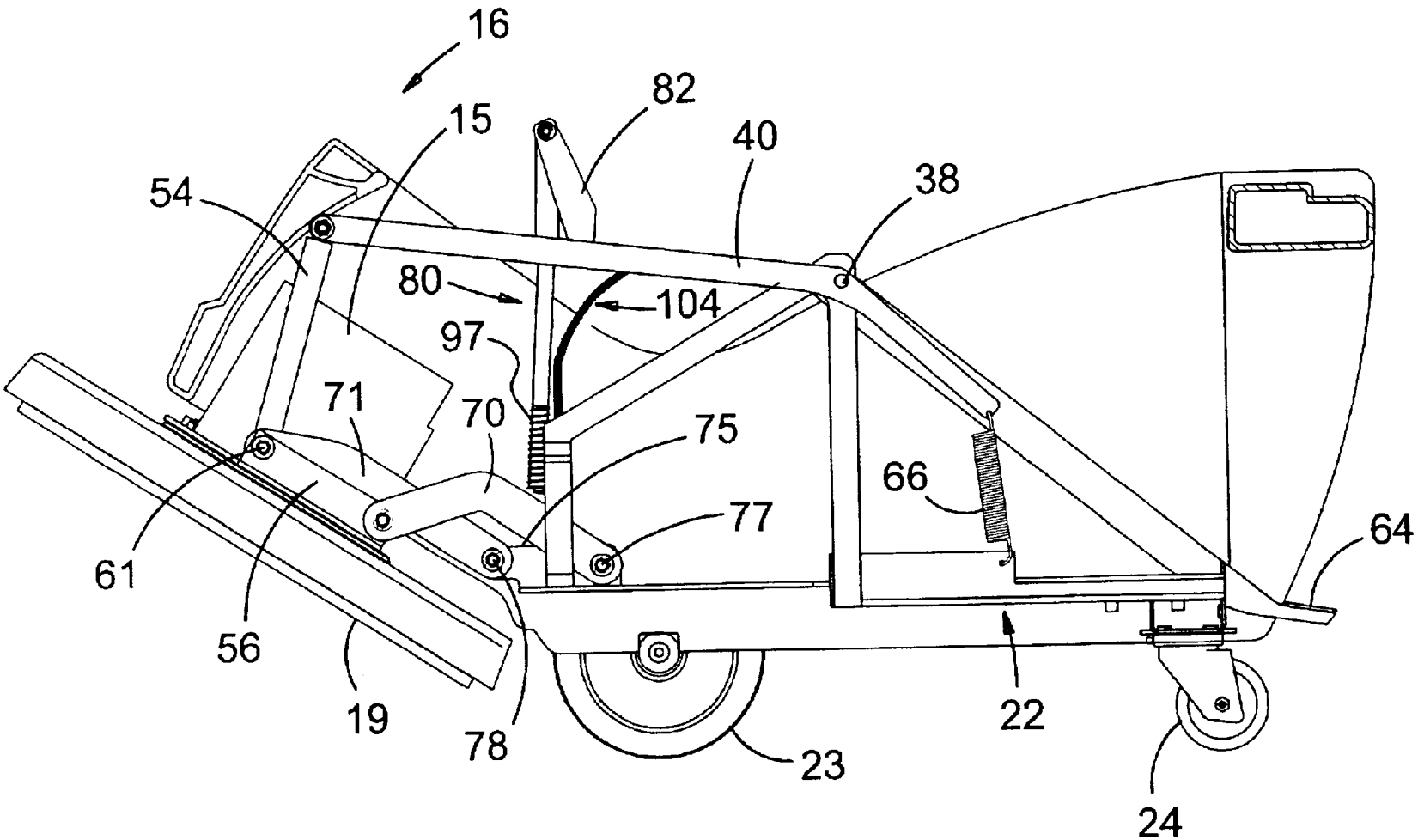
FIG. 2 is a view of the machine similar to FIG. 1, with the head assembly in the raised position.

Referring to FIGS. 1 and 2, reference numeral 10 generally designates a floor burnisher of the type which is adapted to carry a number of storage batteries for power, and in which the operator walks behind the machine to steer it and control it. This type of machine is sometimes referred to as a "walk behind" floor burnisher. In the drawing, the forward direction of the machine is to the left in FIG. 1, and the operator stands to the right of the machine (i.e. behind) as seen in the drawing.

In FIG. 1, the housing for the machine is shown only in silhouette as represented by the light line 12, in order to view the interior framework of the machine, the main lift assembly, and the fine adjust assembly, as will be described. Mounted in front of the machine 10 is a head assembly generally designated 14. The head assembly 14 is located beneath an overhanging bonnet generally designated 16 which is an integral part of the housing 12. The bonnet 16 is designed, as will be described below, to permit the head assembly 14 to be raised for transport, storage or service, as seen in FIG. 2.

The head assembly 14 maybe of conventional design and need not be described in detail to persons skilled in the art. The head assembly 14 includes a motor 15 and a pad driver generally designated 18 which includes a floor polishing element 19 mounted beneath a cover 20. The floor polishing element illustrated in a conventional pad of loosely bound fiber, but it may also be a circular brush of conventional design. The motor 15, as is known, drives the pad 19 in rotation about a generally vertical axis for burnishing the floor.

The machine 10 includes a frame 22 provided with a pair of forward wheels 23, one of which is shown in FIG. 1, and a pair of rear caster wheels, one of which is shown at 24 in FIG. 1.

The head assembly 14 is supported on the frame 22 by a main counterbalance lift assembly generally designated 26, and the head assembly is also mounted to the frame 22 by means of left and right four-bar linkages, generally designated 28. The main lift assembly 26 and the four-bar linkages 28 will be described in more detail below. Briefly, however, the main lift assembly supports the weight of the head assembly 14 in the various positions of use and storage; and the four-bar linkages 28 properly position the pad driver 18 and pad 19 in the various positions assumed by the head assembly 14.

In FIG. 1, the head assembly is in a ready position—that is the position assumed by the pad when it is lowered for use, but before the motor 15 is turned on. As persons skilled in the art will understand, when the motor 15 is turned on, the pad 19 is driven in high speed rotation (typically 2000 rpm or higher), and a suction is created beneath the shroud 20 which draws the pad driver 18 and the entire head assembly 14 downward so that the pad 19 engages the floor for burnishing operation.

As persons skilled in the art will also understand, the pressure exerted by the pad on the floor is monitored for example, by measuring the current draw of the motor 15 from the source of electricity, which may be either batteries, as in the case of the illustrated embodiment, or a conventional wall outlet. The operating pressure of the pad is a function of the current drawn by the motor 15, and a corresponding visual signal (meter or alpha-numeric display) is generated to be viewed directly by the operator at console 30. This enables the operator to perform a fine adjustment with the fine adjustment assembly to be described, while standing behind the operator's console 30 and operating the machine.

Figure 5:
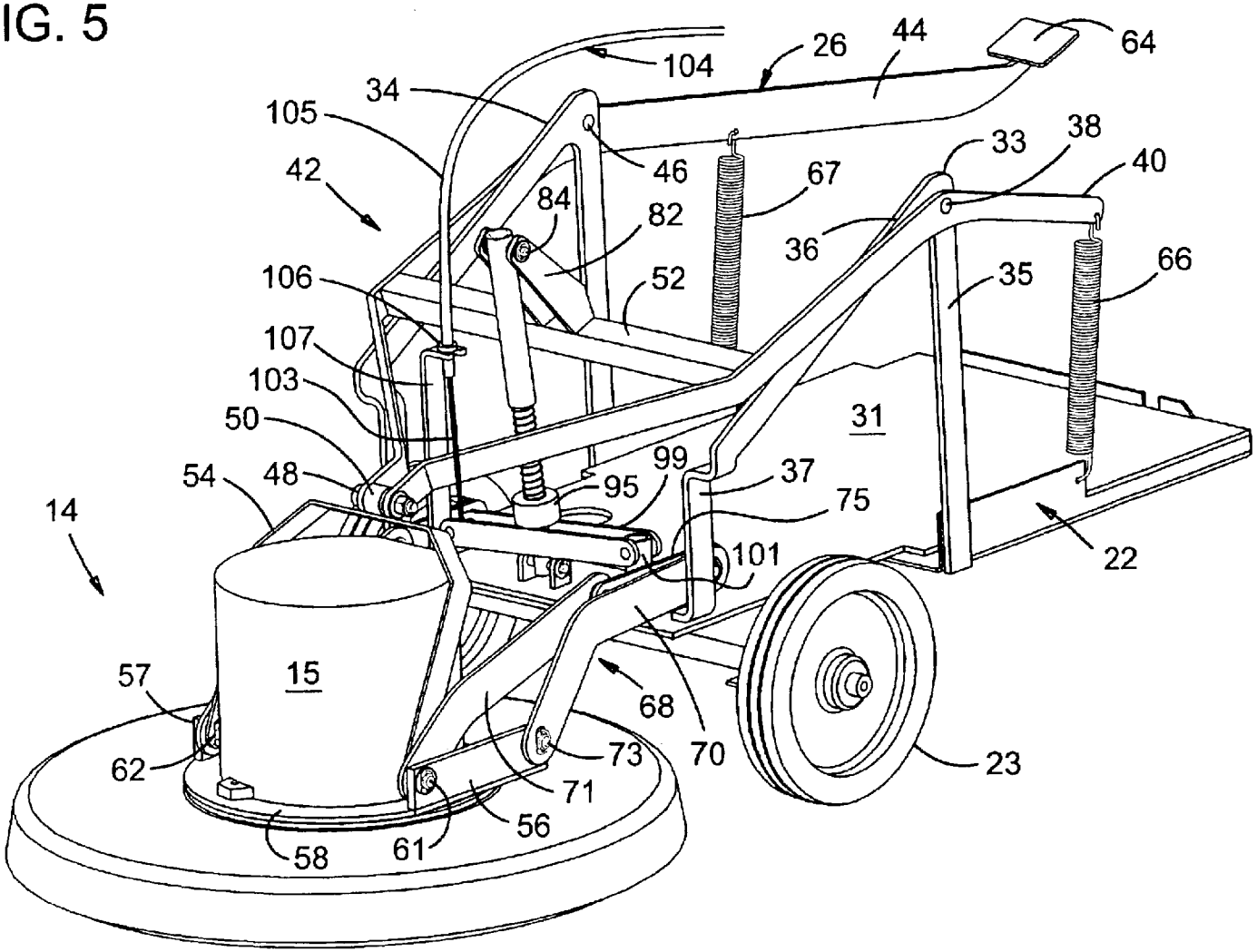
FIG. 5 is a perspective view, taken from the upper, front and left side of the main lift assembly and the fine adjustment support assembly for the machine of FIG. 1.

Turning now to the main lift assembly 26, reference is made principally to FIG. 5. It will be observed from FIG. 5 that the frame 22 includes a horizontal bottom plate 31 which serves as an element of the frame 22 and which supports the storage batteries (not shown for clarity). Mounted to the frame 22 are left and right upright frame members 33, 34 which are seen to be essentially in mirror image of each other so that only the upright frame member 33 need be described in further detail. The frame member 33 includes a vertical support 35, the bottom of which is welded to the frame 22. At the upper portion of the support 35, the frame member 33 extends forwardly and downwardly as at 36 to a forward upright section 37, the bottom of which is welded to plate 31 of the frame 22.

At the junction between the upright support member 35 and the forwardly extending frame member 36 is an aperture receiving a pivot pin which is also received in a corrresponding, aligned aperture 38 of a left arm 40 of a lift frame generally designated 42. Lift frame 42 includes, in addition to the left arm, a right lift arm (or lever) 44 which is pivotally mounted to the right upright frame member 34 at 46. The pivots 38, 46 are aligned, permitting the lift frame 42 to rotate about a common horizontal axis defined by the pivots.

The forward portions of the lift arms 40, 44 are joined together by a nut and bolt 48, which also secure a bushing 50. The bushing 50 is free to pivot about the fastener 48 which forms a pivot pin.

The left and right lift arms 40, 44 are also rigidly joined together by a cross bar 52 into a rigid lift lever supported by frame 22.

Mounted to the front of the lift frame 42, by means of the bushing 50 is a cradle bracket 54 in the general form of an inverted U. The lower ends of the cradle bracket 54 are pivotally mounted to brackets 56, 57 which are welded to a support plate 58 beneath the motor 15 of the head assembly 14.

Still referring to FIGS. 5 and 2, the rear end of the right lift arm 44 is provided with a foot pad 64 located adjacent the operator's console and accessible to the operator. When operator places his foot on the pad 64 and steps onto it, the lift frame 42 pivots about 38, 46 to raise the cradle bracket 54 which raises the head assembly. The amount of force that needs too be exerted by the operator to lift the head assembly, which is of considerable weight, is reduced by a counterbalance including left and right coil springs 66, 67 which are connected under tension between the frame 22 and the left lift arm 40 and right lift arm 44 respectively of the lift lever 42, thereby partially offsetting the weight of the head assembly 14 in all positions of use.

Figure 3:
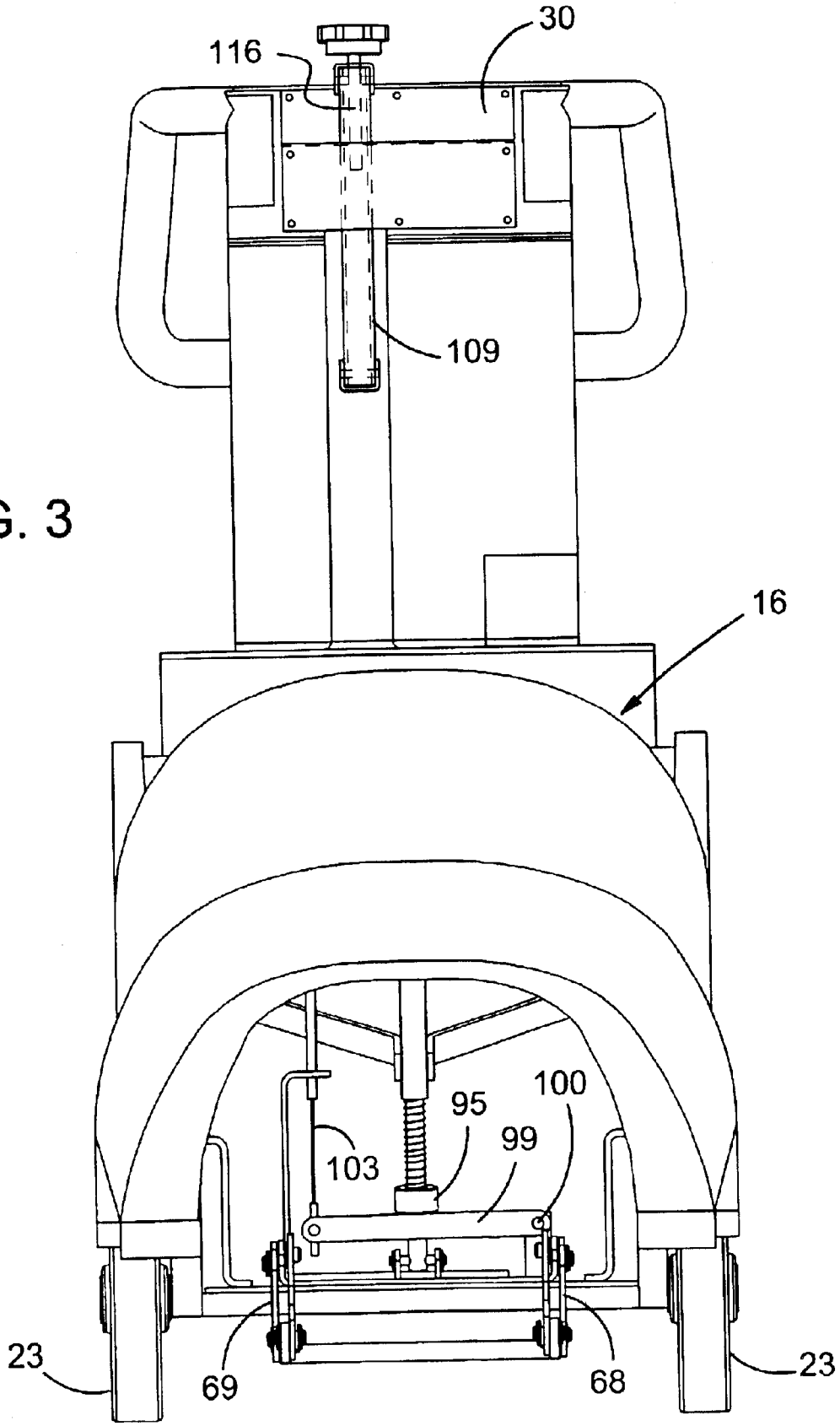
FIG. 3 is a front elevation view of the machine of FIG. 1.

Turning now to the four-bar linkage 28, it includes a left four-bar linkage 68 (FIGS. 3 and 5) and a right four-bar linkage 69. Both left and right four-bar linkages 68, 69 are similar so that only one need be described in further detail for an understanding of the invention.

Turning then to the left four-bar linkage 68 it includes a rear link 70 and forward link 71, both in the form of a dog-leg extending generally forward and then downwardly. The forward end of the rear link 70 is pivotally connected at 73 to the mounting bracket 56 of the head assembly, and the forward end of the forward link 71 is also pivotally connected to the mounting bracket 56 at the previously described pivot 61. The rear of each of the links 70, 71 is pivotally connected at 77, 78 respectively to a bracket 75 welded to the frame 22 as seen best in FIG. 2.

It will thus be appreciated that the four-bar linkage just described holds the pad driver such that the pad 19 is in a generally horizontal position of FIG. 1 when the head assembly 14 is lowered to the ready position, but as seen in FIG. 2, when the head assembly is raised by the main lift assembly 26, the head assembly and pad are tilted so that the pad extends upwardly and forward by the machine, beneath the bonnet 16. This not only facilitates storage and transportation without interference of the head assembly, but it also tilts the pad driver so that the pad is available for inspection, repair or replacement.

The counterbalancing effect of the springs 66, 67 is to offset most of the weight of the head assembly 14. However, at least some of the weight of the head assembly is not offset by design so that when it is desired to lower the head assembly to the ready position, it will assume the ready position.

Figure 4:
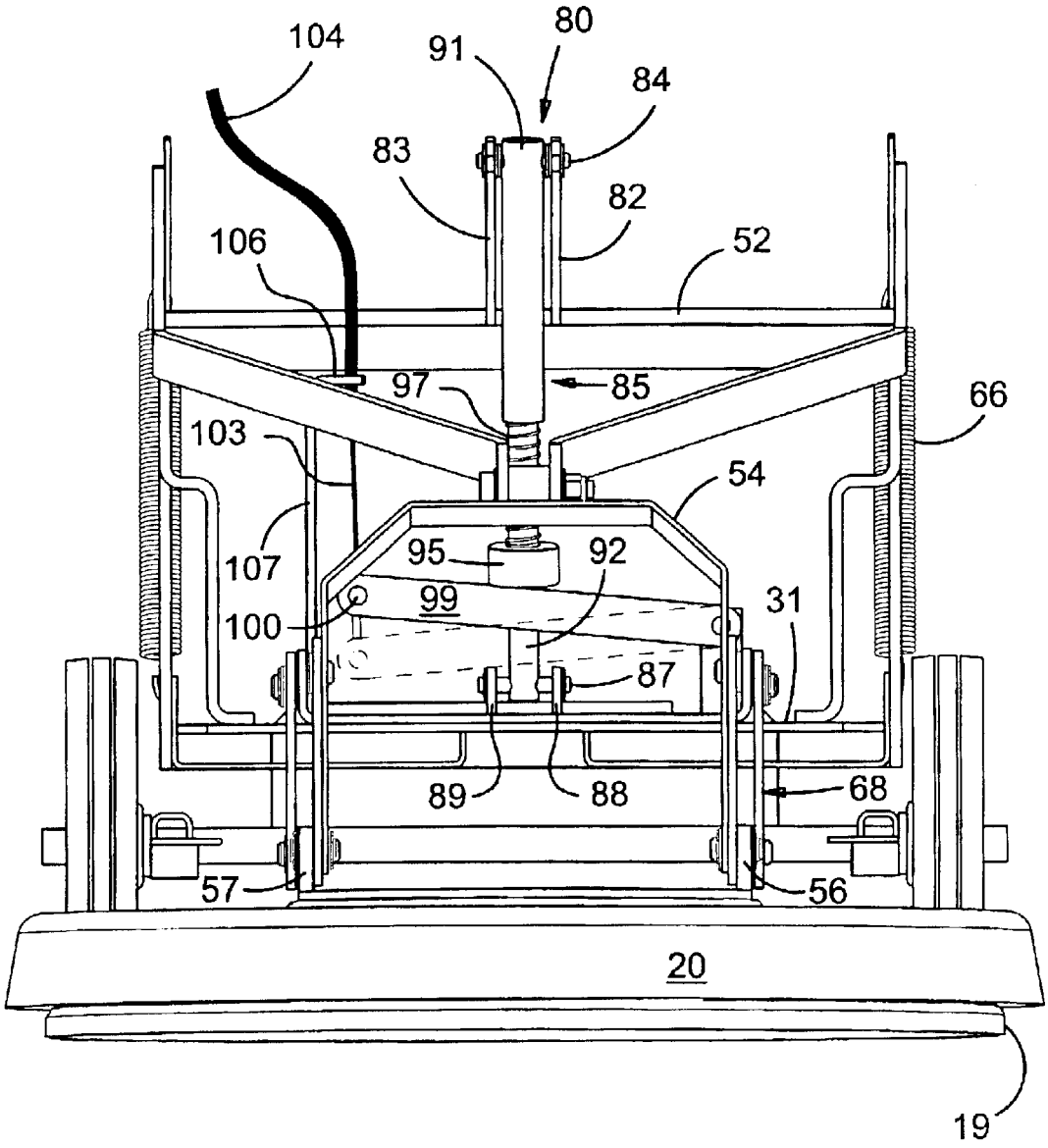
FIG. 4 is a front elevational view of the main lift assembly and the fine adjust assembly for the machine of FIG. 1.

Turning now to the fine adjustment assembly it is generally designated 80 in FIGS. 2 and 4. Referring to FIGS. 2, 5 and 4, a pair of upstanding tabs 82, 83 are welded to the top of the cross frame member 52 of the main lift assembly 26. A pivot 84 is formed in the top of the tabs 82, 83; and a counterbalance assembly generally designated 85 (FIG. 4) is pivotally mounted to the pin 84 and extends downwardly. The bottom of the counterbalance assembly 85 is pivotally mounted to a pin 87 which is received in a pair of tabs 88, 89 welded to the floor 31 of the frame 22. The counterbalance assembly 85 includes an upper tubular member 91 which is pivotally received on the upper pin 84, and a rod 92 which is telescopically received within the tube 91, and has its bottom journalled on the lower pin 87.

A seat 95 in the form of an annulus is slidingly received on the rod 92, and secures the bottom of a spring 97 which is also received on the rod 92. The upper portion of the spring 97 is received within the tube 91 and secured within the tube 91. However, the rod 92 is free to pass within the tube 91.

In operation, the rod 92 remains stationary vertically because it is secured to the frame of the machine, although it may rotate about a horizontal axis defined by the pin 87 in a fore-and-aft direction. The spring 97 exerts an upward force on the tube 91 to urge the tabs 82, 83 towards an upper and slightly clockwise direction, as viewed in FIG. 1.

The counterbalancing force exerted by the fine adjustment assembly 80 adds to the counterbalancing force of springs 66, 67 the main lift assembly 26. However, the counterbalancing force of the fine adjustment assembly 80 is adjustable, as will now be described.

Referring to FIGS. 4 and 5, the seat 95 rests on a dual linkage (that is, a pair of parallel links spaced apart and connected together at each end). One end of the dual link 99, is pivotally connected to an upright tube 101, the bottom of which is welded to the floor 31. The other end of the dual link 99 connected to a metal cable 103 of an adjustable cable assembly generally designated 104. The adjustable cable assembly 104 has the distal end of its cable (as seen in FIG. 5) rigidly attached at 106 to an upright bracket 107, the bottom of which is welded to the floor 31 of the frame 22, and a horizontal upper portion of which extends over the free end of the dual link 99 (FIG. 4).

Figure 6:
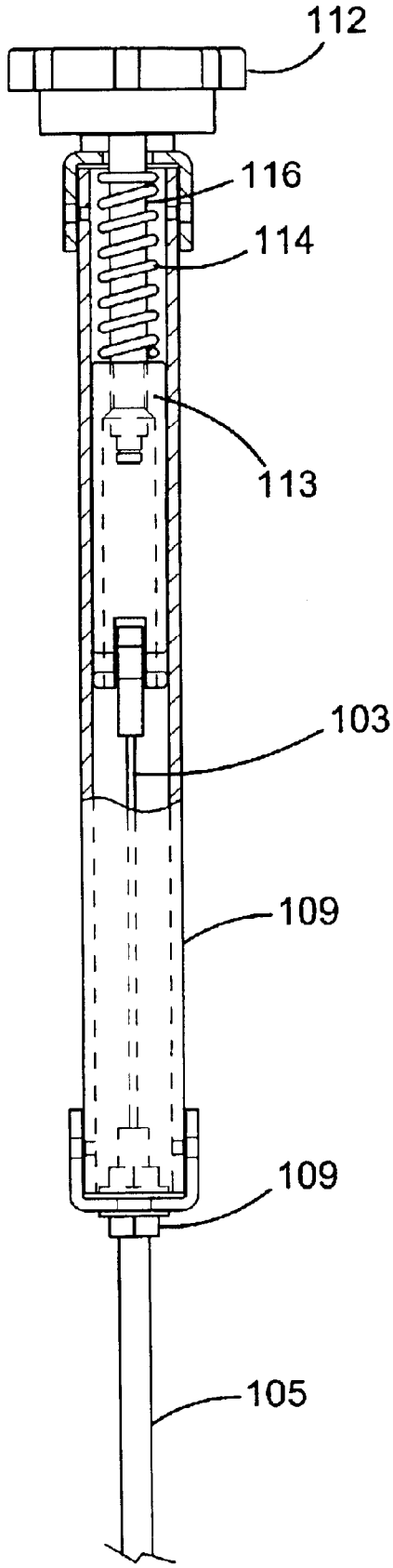
FIG. 6 is an elevational view, partly in phantom to show interior parts, of the adjustment mechanism for the fine adjustment support assembly for the machine of FIG. 1, with the cable assembly broken away.

The cable 103 of the adjustable cable assembly 104 is slidingly received within a sheath 105. As mentioned, the distal end of the sheath 105 is mounted to the bracket 107. The proximal end of the sheath 105 (that is, the end adjacent to the operator) is secured to the base of a square metal tube 109, as at 110 (FIG. 6). The tube 109 is mounted to the operator's console, and at its upper end there is an adjusting knob 112 which has a stem connected to a square slide member 113 which is slidingly received within and guided by the square tube 109, but the slide member 113 cannot rotate within tube 109, thereby causing the slide member and cable to raise and lower the adjusting dual link 99, as illustrated in FIG. 4. A spring 114 urges the slide member 113 downwardly, away from the knob 112 as seen in FIG. 6.

The upper portion of the slide member 113 is internally threaded to form a nut, and a stem 116 of the knob 112 is externally threaded to engage the slide member 113. As the knob 111 is turned in one direction, the slide member 113 is drawn closer to the knob 112 because it is restrained against rotation as described above, against the force of the restoring spring 114, thereby drawing the cable 103 upwardly since the proximal end of the cable 103 is fixed to the slide member 113.

In the case where the slide member 113 draws the cable 103 upwardly, the dual link 99 is raised to the position shown in solid line in FIG. 4. This position causes the spring seat 95 of the counterbalancing mechanism 85 to increase the upward force on the tabs 82, 83 welded to the cross bar 52 of the main lift assembly, thereby increasing the total counterbalancing force tending to raise the head assembly. The total counterbalancing force, in other words, is the sum of the force of the main lift assembly (created by springs 66, 67) and the force created by spring 97 of the fine adjustment assembly. This total force is reduced when the adjusting knob 112 is turned in the opposite direction causing the cable 103 to move away from the adjustment knob 112 under action of the spring 114, and rotating the dual link 99 counterclockwise about pivot 100 to the lower position shown in dash line in FIG. 4.

It will thus be appreciated that although most of the weight of the head assembly is counterbalanced, the operator is also permitted to finely adjust the total counterbalancing force on the head assembly to achieve the desired down pressure on the pad 19 in operation. Preferably, a factory adjustment is made to the fine adjusting mechanism so that the total counterbalancing force by both the main counter to balance lift assembly and the fine adjustment assembly will still enable the head assembly to assume the ready position and be drawn into the operating position when the motor is turned on.

By designing the counterbalancing force of the main lift assembly to be greater than that of the fine adjustment assembly the amount of force exerted by the fine adjustment can be made to be small, thus making the fine adjustment easy. This facilitates accurate setting of pad pressure. To accomplish this, the main springs 66, 67 are selected such that the downward force exerted by the weight of the head assembly on the pad driven results in the application of a force sufficient to produce a pad pressure which is slightly greater than the maximum design pad pressure when the spring 97 creates its minimum restoring or counterbalancing force (i.e. spring 97 the dual link 99 is in its lower most position). As the dual link 99 is raised by the fine adjusting knob and cable assembly, the restoring force is increased, and the net downward force on the pad driven is reduced so that pad pressure is within design limits as set by the operator. The maximum downward force is fixed by a factory adjustment to the cable assembly.

Having thus disclosed in detail one embodiment of the invention, persons skilled in the art will be able to modify certain of the structure which has been shown and to substitute equivalent elements for those disclosed while continuing to practice the principle of the invention; and it is, therefore, intended that all such modifications and substitutions be covered as they are embraced within the spirit and scope of the appended claims.

We claim:

1. In a floor burnisher having a wheeled frame and a head assembly including a motor driving a polishing element, a lift mechanism for moving said head assembly between a raised position for transport or storage and a lowered use position of readiness, said lift mechanism mounted comprising:

a main lift assembly mounted to said frame for pivotal motion about a horizontal axis, said main lift assembly pivotally mounted to said head assembly to carry the same;

a first counterbalancing mechanism connected between said frame and said main lift assembly to provide a first counterbalancing force on said main lift assembly to offset at least partially the weight of said head assembly;

a second counterbalancing mechanism including an adjusting mechanism connected between said frame and said main lift assembly to provide a second counterbalancing force on said main lift assembly adding to said first counterbalancing force, said adjusting mechanism adjusting said second counterbalancing force and thereby adjusting the downward force on said head assembly during use when said polishing element is driven in rotation by said motor and creates suction which forces said polishing element into engagement with a floor surface to be burnished, said second counterbalancing mechanism including a link pivotally connected at one end to said frame;

an actuator under control of an operator to pivot said link about its pivot connection to said frame; and a spring-biased device including a spring and having a first end connected to said lift mechanism, a second end connected to said frame, said spring being arranged to exert an upward counterbalancing force on said lift mechanism tending to raise said head assembly, said link controlling the compression of said spring such that the angular position of said link about its pivot connection adjusts the amount of force exerted by said second counter-balancing mechanism.

2. The apparatus of claim 1 wherein the counterbalancing force of said first counterbalancing mechanism is such that pad pressure is slightly greater than a maximum desired level whereby said second counterbalancing mechanism may reduce pad pressure to an adjusted level less than said maximum desired level.

3. The apparatus of claim 1 wherein said link is a dual link, and further comprising a stop member engaging said dual link and moveable thereby, said stop member engaging said spring to compress the same.

4. In a floor burnisher having a wheeled frame and a head assembly including a motor driving a polishing element, a lift mechanism for moving said head assembly between a raised position for transport or storage and a lowered use position, said lift mechanism comprising:

a main lift assembly mounted to said frame for pivotal motion about a horizontal axis, said main lift assembly pivotally mounted to said head assembly to carry the same;

first counterbalancing mechanism connected between said frame and said main lift assembly to provide a first counterbalancing force on said main lift assembly to offset at least partially the weight of said head assembly;

a second counterbalancing mechanism including an adjusting mechanism connected between said frame and said main lift assembly to provide a second counterbalancing force on said main lift assembly adding to said first counterbalancing force, said adjusting mechanism adjusting said second counterbalancing force and thereby adjusting the downward force on said head assembly during use when said polishing element is driven in rotation by said motor and creates suction which forces said polishing element into engagement with a floor surface to be burnished;

said main lift assembly further comprising first and second arms pivotally mounted to said frame and extending forward of said frame; a cradle bracket pivotally mounted to forward locations of said first and second lift arms and extending generally downwardly for connecting to said head assembly; and first and second four-bar linkages interconnecting said head assembly with said frame such that as said lift mechanism raises said head assembly from said use position to a transport position, said four-bar linkages tilt said head assembly to raise the forward portion thereof to facilitate access to said polishing element of said head assembly.

5. The apparatus of claim 4 wherein said first and second lift arms extend rearwardly of said associated pivot connections to said frame, and wherein said first counter-balancing mechanism includes first and second springs connected respectively between rear locations of said first and second lift arms and said frame to urge forward ends of said lift arms upwardly to counter-balance at least some of the weight of said pad assembly.

6. The apparatus of claim 5 wherein one of said lift arms extends rearwardly to a location adjacent an operator's position and includes a foot pad enabling an operator to raise said head assembly by pressing downwardly on said foot pad.

7. The apparatus of claim 3 wherein said second counterbalancing mechanism includes a tube pivotally connected at an upper end to said lift mechanism and receiving one end of said spring, another end of said spring engaging said stop member; and a rod pivotally connected at one end to said frame and extending through said spring and into said tube, said stop being slidably received on and guided by said rod.

* * * * *

UNITED STATES PATENT AND TRADEMARK OFFICE

CERTIFICATE OF CORRECTION

PATENT NO. : 7,137,876 B2
APPLICATION NO. : 10/316541
DATED : November 21, 2006
INVENTOR(S) : Joseph Immordino, Jr. and Gary E. Palmer It is certified that error appears in the above-identified patent and that said Letters Patent is hereby corrected as shown below:

Title Pg, Item (73) Assignee:

Delete "Woodhead Industries, Inc." and insert --Minuteman International, Inc.--.

Col. 4, line 25. Insert --the-- before frame 22.

Col. 4, line 36. Insert --the-- before operator.

Signed and Sealed this

Fourth Day of August, 2009

John Doll

JOHN DOLL
*Acting Director of the United States Patent and Trademark Office*